US005086255A

United States Patent [19]

Okamoto et al.

[11] Patent Number: 5,086,255

[45] Date of Patent: Feb. 4, 1992

[54] MICROWAVE INDUCED PLASMA SOURCE

[75] Inventors: Yukio Okamoto, Sagamihara; Makoto Yasuda, Kodaira; Masataka Koga, Katsuta, all of Japan

[73] Assignee: Hitachi, Ltd., Tokyo, Japan

[21] Appl. No.: 473,430

[22] Filed: Feb. 1, 1990

[30] Foreign Application Priority Data

Feb. 15, 1989 [JP] Japan ..... 1-033579

[51] Int. Cl.[5] ..... H01J 7/24

[52] U.S. Cl. ..... 315/111.21; 315/111.51; 315/112; 313/231.31

[58] Field of Search ..... 315/111.21, 111.51, 315/111.81, 111.91, 111.71, 112; 313/231.31; 250/423 R

[56] References Cited

U.S. PATENT DOCUMENTS

| | | | |
|---|---|---|---|
| 3,484,650 | 12/1969 | Rendina | 315/111.21 |
| 3,492,074 | 1/1970 | Rendina | 315/111.21 X |
| 4,306,175 | 12/1981 | Schleicher et al. | 315/111.21 |
| 4,517,495 | 5/1985 | Piepmeier | 315/111.21 |
| 4,804,838 | 2/1989 | Miseki | 315/111.21 X |
| 4,818,916 | 4/1989 | Morrisroe | 315/111.21 |
| 4,902,099 | 2/1990 | Okamoto et al. | 315/111.21 X |
| 4,908,492 | 3/1990 | Okamoto et al. | 315/111.21 X |

FOREIGN PATENT DOCUMENTS

| | | |
|---|---|---|
| 3703207 | 8/1988 | Fed. Rep. of Germany . |
| 0198299 | 8/1988 | Japan . |
| 0140600 | 6/1989 | Japan . |
| 0265500 | 10/1989 | Japan . |

OTHER PUBLICATIONS

Abadallah et al., "An Assessment of an atmospheric pressure helium microwave plasma produced by a surfatron as an excitation source in atomic emission spectroscopy", Spectrochimica Acta, vol. 37B, No. 7, pp. 583-592, 1982.

*Primary Examiner*—Eugene R. Laroche
*Assistant Examiner*—Do Hyum Yoo
*Attorney, Agent, or Firm*—Antonelli, Terry, Stout & Kraus

[57] ABSTRACT

A microwave induced plasma source includes a coaxial waveguide made up of a cylindrical outer conductor and an inner conductor which has the form of a helical coil, a discharge tube inserted into the helical coil in the axial direction thereof, and having an inner tube for introducing a sample and an outer tube for introducing a plasma gas so that a double tube structure is formed, a discharge-tube cooling device for causing a cooling gas to flow along the outer periphery of the discharge tube in directions parallel to the axis thereof, and a microwave power source for supplying microwave power to the coaxial waveguide. When the microwave induced plasma source is used as the light source of a spectrometer or the ion source of a mass spectrometer, a trace element can be readily determined qualitatively or quantitatively.

6 Claims, 3 Drawing Sheets

MICROWAVE INDUCED PLASMA SOURCE

BACKGROUND OF THE INVENTION

The present invention relates to an improvement in trace element analyzers utilizing a plasma and used in material and biological sciences for quantitatively determining a trace element such as a plasma source mass spectrometer and a plasma emission spectrometer, and more particularly to an improvement in a plasma generator which utilizes microwave discharge and is used as the plasma sources of the above-mentioned trace element analyzers.

An example of a conventional microwave induced plasma source is described on pages 583 to 592 of Spectrochemica Acta, Vol. 37B, No. 7, 1982. FIGS. 2A and 2B show the structure of this example. In FIGS. 2A and 2B, reference numeral 1 designates a coaxial cable connector for applying a microwave, 2 a microwave coupler, 2' a tuner for the coupler 2, 3 a tuner for adjusting the length g of a gap between the tip of an inner tube 3' and a thin plate 4, 5 a tuner for adjusting the length of a cavity 6, 6' the wall of the cavity 6, 7 a quartz discharge tube, 8 a sample gas, and 9 an inlet for a cooling gas (for example, air).

This plasma source can be used for analyzing a gaseous sample, but does not pay sufficient attention to the analysis of a liquid sample. Thus, there arises a problem that the kind of a sample to be analyzed is limited. Further, the above example has problems that a sample introduction efficiency is low and the ionization efficiency of an introduced sample is also low.

In more detail, as is apparent from FIGS. 2A and 2B, microwave power for producing a plasma is supplied to the cavity 6 through a coaxial cable. Hence, the microwave power supplied to the cavity is 500 W at most, and it is impossible to analyze a liquid sample directly. Moreover, a large power loss is generated in the coaxial cable. Further, the coupler 2 has a complicated structure, and it is not easy to adjust the coupler 2.

Additionally, the plasma formed in the above example is based upon a surface wave. Hence, it is impossible to generate a plasma having the form of a doughnut, sufficiently. Further, the mixture of a sample and a plasma gas is supplied to the discharge tube. Accordingly, the sample introduction efficiency is low, and the ionization efficiency of the introduced sample is also low. Thus, the detection limit of a trace element (that is, sensitivity for the trace element) is low.

SUMMARY OF THE INVENTION

It is an object of the present invention to provide a microwave induced plasma source which can solve the above-mentioned problems and can be used as the plasma source of a trace element analyzer utilizing a plasma.

In order to attain the above object, according to the present invention, there is provided a microwave induced plasma source, in which, as shown in FIG. 1, a coaxial waveguide made up of inner and outer conductors is supplied with a microwave, the inner conductor provided for a plasma generating part is formed of a helical coil to excite a circularly polarized wave, and a discharge tube is inserted into the helical coil to form a plasma in the discharge tube with the aid of the circularly polarized wave.

Further, the discharge tube has at least a double tube structure, to introduce a sample and a plasma gas separately into the discharge tube and to supply the sample efficiently in a central portion of a plasma formed of the plasma gas.

Further, a cooling gas (for example, air) is caused to flow along the outer periphery of the discharge tube in directions parallel to the axis thereof, to efficiently cool at least the discharge tube.

Referring to FIG. 1, when the inner conductor of the coaxial waveguide is formed of a helical coil 30, a high-frequency current flowing through the coil 30 generates a radial electric field and an induced axial magnetic field in the discharge tube 70, and thus a circularly polarized mode is produced. Owing to the circularly polarized mode, a doughnut-shaped plasma 100, i.e., a plasma wherein the plasma temperature in a peripheral portion is higher than that of the plasma temperature in a central portion, is efficiently formed from a plasma gas 80 introduced into the discharge tube 70.

Further, a liquid sample 90 from a nebulizer (not shown) is introduced into a central portion of the doughnut-shaped plasma 100 by means of a sample inlet pipe 71. Thus, the liquid sample 90 can be efficiently dissociated (that is, atomized), excited, and ionized.

Further, a cooling gas (for example, air) 60 is introduced in a refrigerator 50 through an inlet pipe 51 so that the cooling gas 60 flows along the outer periphery of the discharge tube 70 in directions parallel to the axis thereof. Thus, not only the discharge tube 70 but also the helical coil 30 can be effectively cooled.

DESCRIPTION OF THE PREFERRED EMBODIMENTS

Now, embodiments of the present invention will be explained below, with reference to the drawings.

Figure 1:
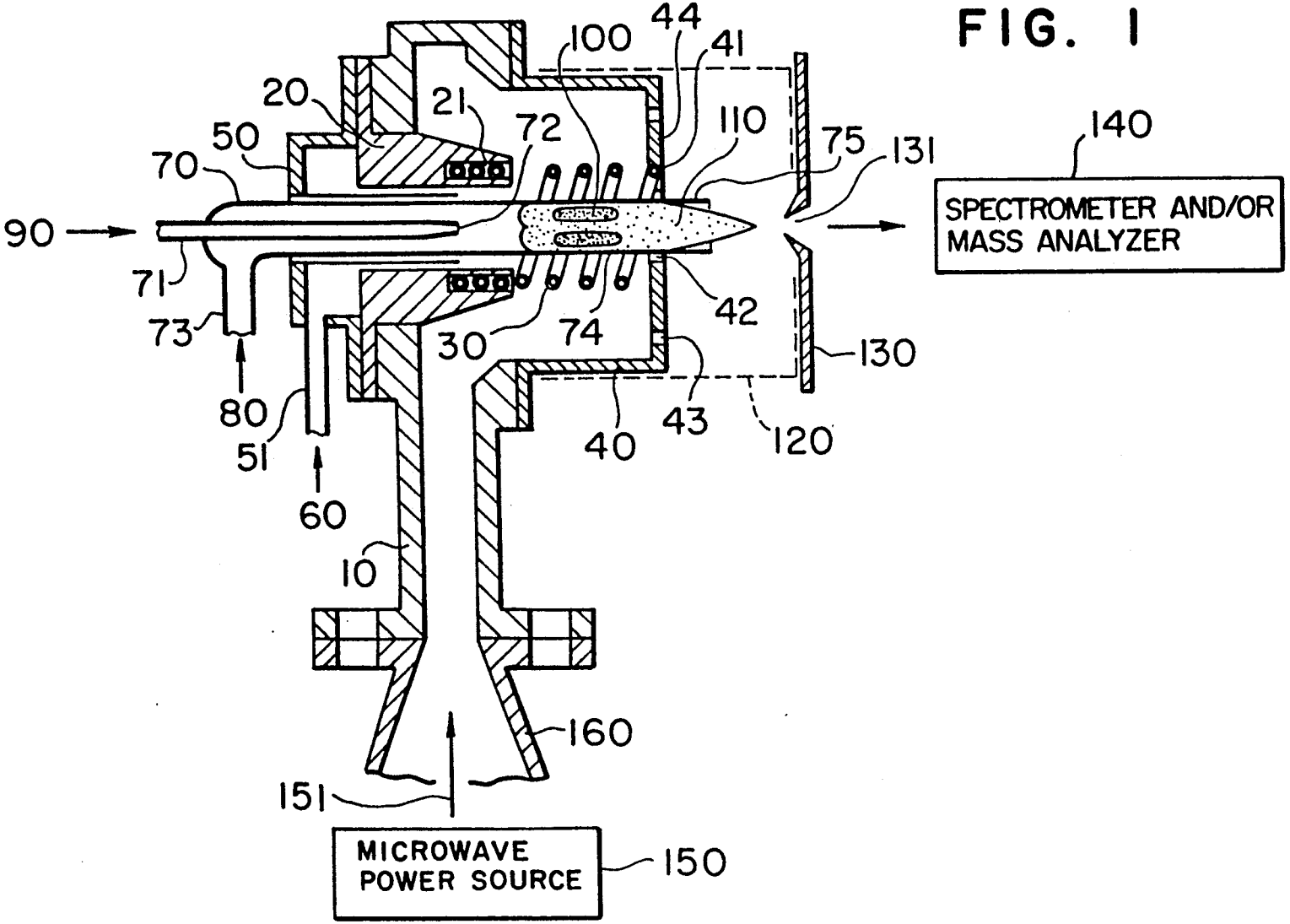
FIG. 1 is a longitudinal sectional view showing the basic construction of an embodiment of a microwave induced plasma source according to the present invention.
Figure 2A:
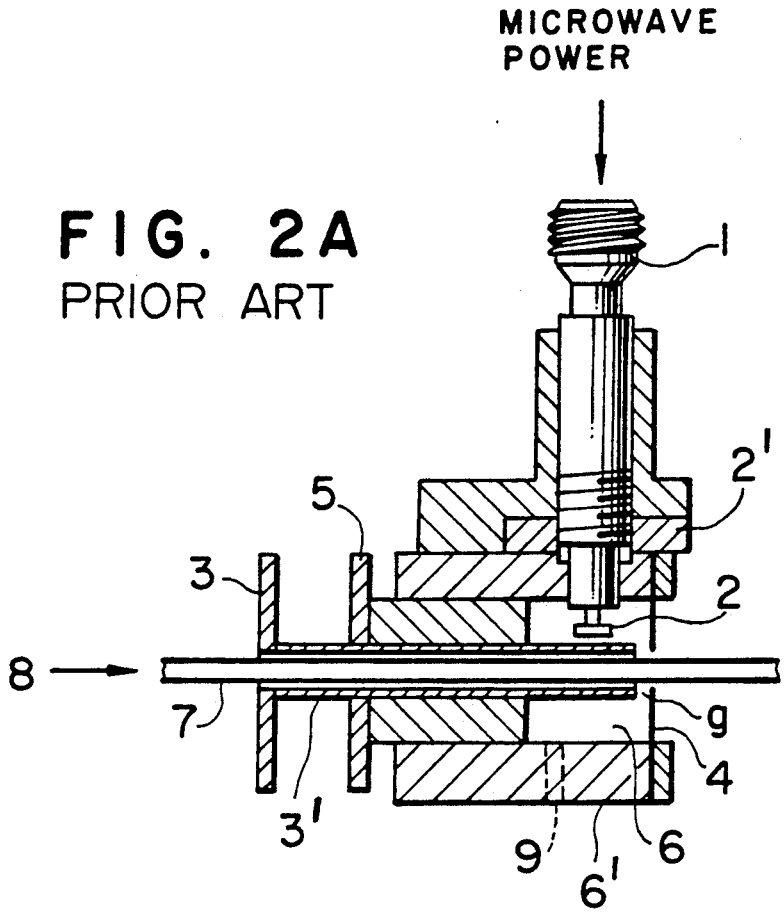
FIG. 2A PRIOR ART
FIGS. 2A and 2B are longitudinal and transverse sectional views showing an example of a conventional microwave induced plasma source, respectively.
Figure 2B:
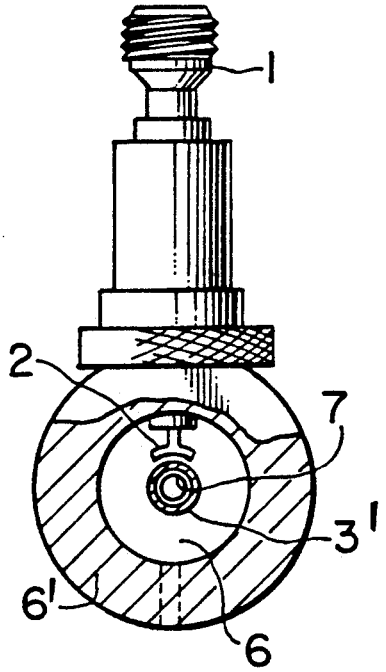
FIG. 2B PRIOR ART

FIG. 1 shows the basic construction of an embodiment of a microwave induced plasma source according to the present invention. In FIG. 1, reference numeral 10 designates a plane waveguide made of copper or other metals and having internal dimensions of, for example, 8.6 mm × 109.2 mm × 84 mm, 20 a coaxial transformer made of copper or other metals and having the form of, for example, a truncated circular cone, in which the diameter of the bottom is 30 mm and the diameter of the top is 20 mm, and 30 a helical coil made of copper or other metals and having a coil diameter of, for example, 5 to 20 mm, a coil pitch of, for example, 2 to 10 mm, the diameter of a wire of the coil being in a range, for example, from 1 to 10 mm, and the number of turns being in a range, for example, from 1 to 10. One end of the helical coil 30 is inserted in and held by a groove 21 which is provided in the coaxial transformer 20. Further, a cylindrical outer conductor 40 is made of copper or other metals, and has an inner diameter of, for example, 40 mm and a length of, for example, 20 to 70 mm. A through hole 42 having a diameter larger than the outer diameter of a discharge tube 70 is provided in an end wall 44 of the outer conductor 40, to pass the discharge tube 70 through the end wall 44. Further, hole 41 for fixing the other end of the helical coil 30 is provided in the end wall 44. In a case where the helical coil 30 is put in a floating state, the hole 41 is not provided. A plurality of air holes 43 may be provided in the end wall 44, if necessary. The air holes 43 can reduce a sound which is generated by air cooling. Further, in FIG. 1, reference numeral 50 designates a refrigerator made of copper or other metals, 51 a cooling-gas inlet pipe, 60 a cooling gas (for example, high-pressure air), 71 a sample inlet pipe made of quartz, ceramics, or other materials and having a thin tip 72, 73 a plasma gas inlet pipe connected to the discharge tube 70 for introducing a plasma gas 80 (for example, argon, nitrogen, helium, or other gases) into the discharge tube 70, 90 a mixture of a sample and a carrier gas identical with the plasma gas 80 which mixture is supplied from a nebulizer (not shown) and will hereinafter referred to as a "sample", 100 a high-temperature, doughnut-shaped plasma, 110 a diffused plasma, and 120 a cylindrical shielding case made of stainless steel for preventing the leakage of microwave power. That is, the shielding case 120 is provided for the purpose of safety and protection. The shielding case 120 has a plurality of holes for discharging heated air to the outside. A port for the optical measurement of the plasma may be provided in the shielding case 120, if necessary. Further, in FIG. 1, reference numeral 130 designates a sampling cone made of nickel or other metals and having at the center thereof an aperture 131 with a diameter of 0.5 to 1.0 mm, 140 a spectrometer (including a vacuum spectrometer) for spectrochemically analyzing light which is emitted from the plasma, and/or a mass analyzer (for example, a mass spectrometer) including an ion extracting interface for carrying out mass spectrometric analysis of ions which are produced in the plasma, 150 a microwave power source for supplying, for example, 0.5 to 5 KW of 2.45 GHz microwave power 151, and 160 a tapered waveguide for connecting a standard waveguide (not shown) and the plane waveguide 10.

Next, the fundamental operation of the present embodiment will be explained. Microwave power 151 emitted from the microwave power source 150 is transmitted to the plane waveguide 10 through the standard waveguide and the tapered waveguide 160. It is needless to say that an isolator (not shown), a power meter (not shown), and a tuner (not shown) are disposed in the propagation path from the microwave power source 150 to the plane waveguide 10. The microwave power supplied to the plane waveguide 10 is supplied to the helical coil 30 (namely, the inner conductor) through the coaxial transformer 20. At this time, a high-frequency current flows through the helical coil 30, and thus a radial electric field and an axial magnetic field are generated. The plasma gas 80 introduced into the discharge tube 70 is excited and ionized by the action of the above electric and magnetic fields, and thus the doughnut-shaped plasma 100 is generated. When the sample 90 is introduced from the sample inlet pipe 71 into a central portion of the doughnut-shaped plasma 100, the sample 90 is efficiently dissociated, excited, and ionized, without being diffused into the peripheral portion of the plasma. At this time, light generated in the plasma can be analyzed by means of the spectrometer 140, and ions produced in the plasma can be analyzed by the mass analyzer 140.

Figure 3A:
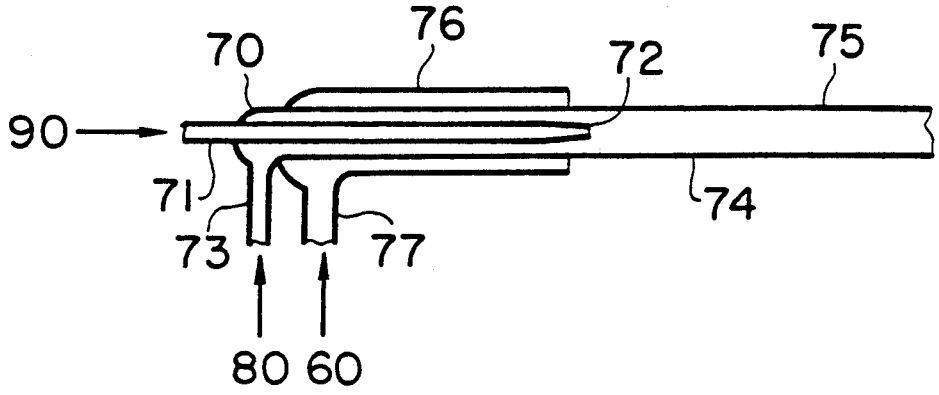
FIGS. 3A, 3B and 3C are schematic diagrams showing the discharge tube portions of other embodiments of a microwave induced plasma source according to the present invention.
Figure 3B:
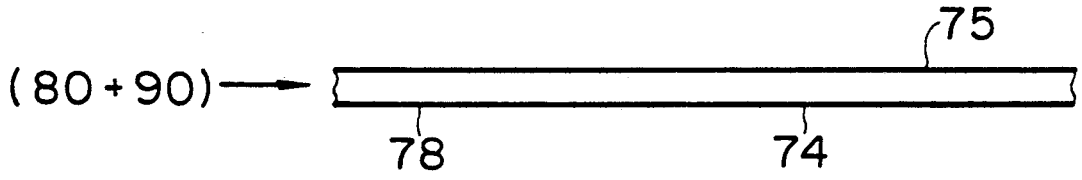
Figure 3C:
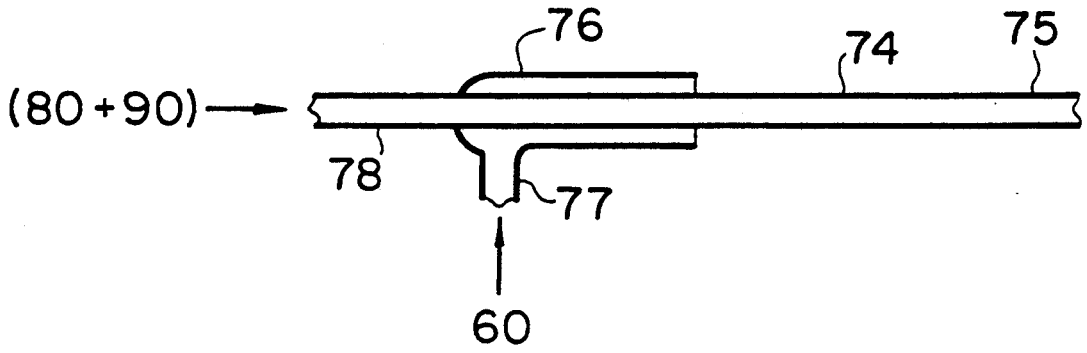

FIGS. 3A, 3B and 3C show modified versions of the discharge tube 70. In more detail, FIG. 3A shows a case where a cooling tube 76 is arranged on the outside of the discharge tube 70, and the cooling gas 60 is introduced from an inlet pipe 77 into the cooling tube 76 to cause the cooling gas 60 to flow along the outer periphery of the discharge tube 70 in directions parallel to the axis thereof. In this case, the refrigerator 50 and cooling-gas inlet pipe 51 of FIG. 1 are unnecessary. The structure shown in FIG. 3A is superior in ability to cool the discharge tube 70 to the cooling means of FIG. 1.

On the other hand, FIGS. 3B and 3C show a case where the mixture of the plasma gas 80 and the sample 90 is supplied to a discharge tube 78 as in the conventional plasma source, that is, show simplified discharge tubes. Further, the diameter of that portion 74 of the discharge tube 70 or 78 which is placed in the helical coil 30, is appropriately determined in accordance with a purpose. Furthermore, an end portion 75 of the discharge tube 70 or 78 may have an appropriate shape such as a circular cone, in accordance with a purpose (for example, stabilization of plasma, reduction in loss, or radiation of heat).

As has been explained in the foregoing, in a microwave induced plasma source according to the present invention, the helical coil of the coaxial waveguide and the discharge tube having a double tube structure are simultaneously cooled by causing a cooling gas to flow along the outer periphery of the discharge tube in directions parallel to the axis thereof, that is, cooling means having a simple structure is used. Moreover, a doughnut-shaped plasma can be stably formed even when microwave power of more than 0.5 KW is supplied to the waveguide. Accordingly, not only a gaseous sample but also a liquid sample can be efficiently dissociated, excited, and ionized. Thus, a microwave induced plasma source according to the present invention can increase the detection limit of a trace element contained in a sample by a factor of 10 or more, as compared with a case where the trace element is quantitatively determined by using the conventional plasma source. For example, when a microwave induced plasma source according to the present invention is used, the detection limit of calcium is 1 ppb or less.

Further, a microwave induced plasma source according to the present invention is simple to adjust and easy to operate.

Additionally, the microwave induced plasma source is provided with a shielding case. Accordingly, the trouble due to the leakage of microwave is lessened.

We claim:

1. A microwave induced plasma source comprising:

a coaxial waveguide formed of a cylindrical outer conductor and an inner conductor, the inner conductor being formed of a helical coil;

a discharge tube having a double tube structure and being inserted into the helical coil in an axial direction thereof, the double tube structure being formed of an inner tube for introducing a sample and an outer tube for introducing a plasma gas;

discharge-tube cooling means for causing a cooling gas to flow along an outer periphery of the discharge tube in directions parallel to an axis thereof; and means for supplying microwave power to the coaxial waveguide.

2. A microwave induced plasma source according to claim 1, further comprising a shielding case for preventing leakage of microwave power from the coaxial waveguide to the outside.

3. A plasma source mass spectrometer comprising:

a microwave induced plasma source including a coaxial waveguide, a discharge tube, discharge-tube cooling means, and means for supplying microwave power to the coaxial waveguide, the coaxial waveguide being formed of a cylindrical outer conductor and an inner conductor, the inner conductor being formed of a helical coil, the discharge tube having an inner tube for introducing a sample and an outer tube for introducing a plasma gas so that a double tube structure is formed, the discharge tube being inserted into the helical coil in an axial direction thereof, the discharge-tube cooling means causing a cooling gas to flow along an outer periphery of the discharge tube in directions parallel to an axis thereof; and a mass spectrometer for carrying out mass spectrometric analysis of ions ejected from a plasma which is generated in the microwave induced plasma source.

4. A plasma emission spectrometer comprising:

a microwave induced plasma source including a coaxial waveguide, a discharge tube, discharge-tube cooling means, and means for supplying microwave power to the coaxial waveguide, the coaxial waveguide being formed of a cylindrical outer conductor and an inner conductor, the inner conductor being formed of a helical coil, the discharge tube having an inner tube for introducing a sample and an outer tube for introducing a plasma gas so that a double tube structure is formed, the discharge tube being inserted into the helical coil in an axial direction thereof, the discharge-tube cooling means causing a cooling gas to flow along an outer periphery of the discharge tube in directions parallel to an axis thereof; and a spectrometer for carrying out spectrochemical analysis of light emitted from a plasma which is produced in the microwave induced plasma source.

5. A microwave induced plasma source comprising:

a coaxial waveguide formed of a cylindrical outer conductor and an inner conductor, the inner conductor being formed of a helical coil;

a discharge tube inserted into the helical coil in an axial direction thereof such that a gap is formed between the discharge tube and the helical coil;

discharge-tube cooling means for causing a cooling gas to flow through the gap between the discharge tube and the helical coil in directions parallel to an axis of the discharge tube; and means for supplying microwave power to the coaxial waveguide.

6. A microwave induced plasma source comprising:

a coaxial waveguide formed of a cylindrical outer conductor and an inner conductor, the inner conductor being formed of a helical coil;

a discharge tube having a double tube structure and being inserted into the helical coil in an axial direction thereof such that a gap is formed between the discharge tube and the helical coil, the double tube structure being formed of an inner tube for introducing a sample and an outer tube for introducing a plasma gas;

discharge-tube cooling means for causing a cooling gas to flow through the gap between the discharge tube and the helical coil in directions parallel to an axis of the discharge tube; and means for supplying microwave power to the coaxial waveguide.

* * * * *